US005153049A

United States Patent [19]

Groshens

[11] Patent Number: 5,153,049

[45] Date of Patent: Oct. 6, 1992

[54] TEXTILE BASE MATERIAL, IN WOVEN OR WEFT KNITTED FABRIC, FOR THERMOBINDING INTERLINING

[75] Inventor: Pierre Groshens, Doingt Flamicourt, France

[73] Assignee: Lainiere de Picardie (S.A.), France

[21] Appl. No.: 771,361

[22] Filed: Oct. 1, 1991

[30] Foreign Application Priority Data

Oct. 17, 1990 [FR] France ..... 90 13134

[51] Int. Cl.[5] ..... B32B 3/00

[52] U.S. Cl. ..... 428/196; 2/272; 139/420 R; 428/197; 428/198; 428/229; 428/253; 428/257; 428/258; 428/259; 428/225

[58] Field of Search ..... 428/196, 197, 229, 257, 428/258, 259, 253, 254, 198, 201, 402, 218, 225; 139/420 R; 2/272

[56] References Cited

U.S. PATENT DOCUMENTS

| | | | |
|---|---|---|---|
| 4,415,622 | 11/1983 | Kamat | 428/196 |
| 4,450,196 | 5/1984 | Kamat | 428/257 |
| 4,634,625 | 1/1987 | Franklin | 428/257 |
| 4,737,396 | 4/1988 | Kamat | 428/257 |
| 4,830,907 | 5/1989 | Sawyer et al. | 428/225 |
| 5,034,261 | 7/1991 | Loubinoux et al. | 428/198 |

FOREIGN PATENT DOCUMENTS 2019305 10/1979 United Kingdom .

*Primary Examiner*—James J. Bell
*Attorney, Agent, or Firm*—Ladas & Parry

[57] ABSTRACT

The base material for thermobinding interlining is constituted of a woven fabric or of a weft knitted fabric or weft knit. According to the invention, at least the weft of the woven fabric or of the weft knit is in synthetic yarns, for example of 35 to 500 dtex, composed of thin filaments having a unit count less than 1.3 dtex. Preferably, these yarns are textured yarns.

The thermobinding interlining is constituted of the woven fabric or of the weft knit, on one face of which dots of thermofusible polymer have been deposited.

1 Claim, No Drawings

TEXTILE BASE MATERIAL, IN WOVEN OR WEFT KNITTED FABRIC, FOR THERMOBINDING INTERLINING

FIELD OF THE INVENTION

The present invention relates to a textile base material for interlining garment pieces, notably intended for constituting a thermobinding interlining by deposition of thermofusible polymer.

BACKGROUND OF THE INVENTION

There are two categories of base materials for thermobinding interlinings: the textile base materials proper and the nonwovens. The textile base materials proper are obtained by weaving or knitting of yarns, while the nonwovens are obtained by formation and consolidation of a web of fibers or filaments.

The use of nonwovens as interlining base material presents advantages, particularly as regards production costs. There are nevertheless certain disadvantages, due in particular to their production method. Due to the fact that the fibers or filaments are deposited in web form, without there being any accurate control of the direction taken by the fibers or filaments throughout the width of the web, density differences and surface irregularities occur in the nonwoven. Also, because of the irregular distribution, directionwise, of the fibers or filaments, the nonwoven has insufficient dimensional stability: it can be irreversibly deformed under the effect of an extension, which, in the case of an interlining, causes a poor stabilization of the garment piece on which said nonwoven has been thermobonded.

In spite of their high cost price, the textile base materials proper are preferred in those applications where the aforesaid disadvantages presented by the nonwovens are redhibitory. The production method, by weaving or knitting, of such base materials, gives them the homogeneity, notably directionwise, lacking in the nonwovens.

In the field of thermobinding interlinings, the aim is also that the thermofusible polymer should not spread through inside the interlining base material, as this would locally rigidify the base material and, consequently, the garment piece. It is understandable that, for an equal weight, a given polymer diffuses through with all the more difficulty as the surface of the base material on which said polymer is deposited is dense, i.e. that the space between the various fibers or filaments constituting the base material is reduced. From a structural standpoint, for an equal weight, the nonwoven has a much denser surface than the textile base material.

SUMMARY OF THE INVENTION

The aim of the Applicant is to provide a textile base material for thermobonding interlinings, which has all the technical advantages of both the nonwovens and the textile base materials, without any of their disadvantages. In particular, the base materials considered most suitable for interlining, should have a controlled stability, while retaining adequate elasticity and resiliency, and the thermofusible polymer should not spread therethrough during its deposition or during the application of the interlining on the garment piece.

This aim is unquestionably reached with the base material for thermobinding interlining according to the invention. This base material is of the textile base material type in that it is constituted of a wovenfabric or of fabric with laid-in yarns also known as weft knitted fabric or weft knit. Characteristically, at least the weft of the woven fabric or of the weft knit is made of synthetic yarns, composed of thin filaments with a count less than 1.3 dtex.

The fact of using yarns composed of thin filaments confers to the weft which will be in contact with the thermofusible polymer, a greater density of filaments for an equal weight, said filaments nonetheless retaining a given orientation. With this particular disposition, it is possible to obtain a relatively dense surface without the characteristics of stability, elasticity and resiliency being in any way reduced. Unexpectedly, it has been found that the non-penetration of the thermofusible polymers normally used in thermobinding interlinings, was achieved with weft yarns composed of filaments having a count less than 1.3 dtex.

Indeed, the crimp caused by texturing gives to the weft yarn in the interlining base material, a volume, a greater bulk, comparatively to the continuous filament yarns, thereby further increasing the effect of barrier against the thermofusible polymer and improving the suppleness of the base material. Moreover, and in known manner, the use of the textured yarns makes it possible to adjust the elasticity and the resiliency of the base material.

It is true that synthetic yarns composed of filaments, in particular textured filaments, were already used for thermobonding interlinings, but the corresponding base materials had all the disadvantages referred to hereinabove. It is to the Applicant's credit to have thought and proved that the use of a particular type of synthetic yarns, having a count less than 1.3 dtex, could overcome said disadvantages while preserving the advantages of the conventional textile base materials.

And moreover, because of the thinness of the filaments constituting the weft yarns, the surface of the base material is very regular, this having the added advantage of facilitating the deposition of the thermofusible polymer whatever the method used.

It has finally been found that the use of yarns having a count less than 1.3 dtex had a completely unexpected advantage for cutting said base materials in stack form. Indeed, it is sometimes found that the different layers of the cut stack adhere to one another, and that it is difficult to separate the layers in clothes manufacturing. This adherence phenomenon can be explained by the fact that the ends of the cut filaments in two adjacent layers are sticking together, this being more so in the case of textured yarns. It has now been found, on the one hand, that the textile base material according to the invention is easier to cut due to its finer count, and on the other hand, that it is not subject, when cut into stacks, to said adherence phenomenon. It does seem that filaments of count less than 1.3 dtex are easier to cut, and even break under mechanical force if the cutting tool is not perfectly sharp, and also that since said filaments are more supple, there is practically no possibility for the filaments of two adjacent layers to stick together.

It is another object of the invention to protect a thermobinding interlining constituted of a woven fabric or of a weft knit of which at least the weft is made of synthetic yarns composed of thin filaments having a count less than 1.3 dtex, and on one face of which dots of thermofusible polymer have been deposited.

Preferably, the density of warp yarns is considerably lower than the density of weft yarns. In such a case, the warp yarns only serve to bind the weft yarns and the surface appearance and volume of the textile base material are conferred nearly exclusively by the weft yarns of count lower than 1.3 dtex, thus giving a uniform and smooth surface and a very good cover, particularly suitable for the printing of the thermofusible products, in powder or paste form. It has been found that it is possible to produce on the base materials constituted according to the invention, finer printings, for example with 200 points per square centimeter, which is virtually impossible with base materials of the same type containing filaments of count higher than 1.3 dtex.

DETAILED DESCRIPTION OF PREFERRED EMBODIMENT

Other characteristics and advantages of the invention will be more readily understood on reading the following description of one embodiment of a thermobinding interlining containing microfilaments.

The textile base material for interlining is a knitted fabric or weft knit, of weight 15 to 100 g/m2, produced on a warp-type or Raschel knitting machine with weft insertion. In this knitted fabric, a yarn called weft yarn by analogy with weaving is introduced regularly through the stitches across the width of the knitting.

The weft yarn is a yarn of textured polyester of between 35 and 500 dtex. Each one of the filaments or strands constituting said yarn, has a count of around 1 dtex. These fine filaments are referred to hereinafter as microfilaments. The yarns constituting the stitches of the knitting are textured polyester or polyamide yarns, or flat yarns of 22 to 50 dtex, the filaments of which have a count of 0.5 to 4 dtex.

After knitting, the weft knit undergoes a thermal shrinking treatment.

The knitting thus treated has one face of which the outer surface is principally composed of weft yarns, hence of microfilaments.

A thermofusible polymer is deposited on said face. The choice of such polymer and the method for depositing it on the face of the textile base material, are not characteristic of the present invention. It can be for example, thermoplastic copolyamide and/or copolyester and/or chemical derivatives of either or both, alone or in combination with other thermoplastic copolymers.

In the case of a thermobonding material in aqueous dispersion, this is applied on the textile base for example by rotary screen printing.

In the case of a thermobonding material in powder form, this is applied on the textile base for example by means of deep-engraved cylinders either in the form of piles of powder subsequently heated, or directly in the form of dots of melted polymers. In the latter case, the cylinder is heated to a temperature higher than 120° C.

The thermofusible polymer can also be deposited on the textile base according to the invention in two operations, such as taught in document EP.0219378, i.e. in a first operation, deposition of the thermofusible polymer on an antiadhesive base by either screen-type printing, or deep-engraved cylinder printing, and in a second operation, transfer of the polymer in molten state, onto the textile base.

No matter what method is used for applying the thermofusible polymer on the above-described weft knit, it has been found that, in normal conditions of operation, the thermobinding polymer virtually remains on the surface of the weft knit, i.e. that its penetration is limited to the first superficial microfilaments of the yarns constituting the weft, a condition which is necessary for the deposition points to be anchored in the base material, and which is sufficient to prevent any localized hardening of the base material and of course to prevent the polymer from spreading through the interlining while the garment is produced.

The obtained thermobonding interlining is very supple and has a very uniform surface. It has a perfectly controlled stability and retains an elasticity and resiliency adapted to its various applications.

The invention is in no way limited to the embodiment described hereinabove by way of example and non-restrictively, but on the contrary covers any variants. In particular, the textile base material for thermobinding interlining can be constituted exclusively of synthetic yarns composed of microfilaments of at least 1.3 dtex.

The invention finds a particular application in satin-type articles in which one of the two faces comprises floats which are made of synthetic yarns composed of thin filaments having a count less than 1.3 dtex, and which gives to said articles a very dense surface. Said articles may be either woven articles proper, or knitted articles with double lap weft stitches, meaning that they include a knitted lap with a weft of microfilaments, binded by the stitch weave, in which are inserted straight yarns, parallel to the columns of stitches, giving to this double lap article a woven satin effect. Articles of this type are described for example in document FR-A-2 260 138: preferably the inserted weft yarns are in textured polyester with a count less than 1.3 dtex.

What is claimed is:

1. Thermobinding interlining constituted of a woven fabric or of a weft knit on one face of which dots of thermofusible polymers have been deposited, wherein at least the weft of the woven fabric or of the weft knit is made of synthetic yarns composed of thin filaments having a count less than 1.3 dtex.

* * * * *